US005210463A

United States Patent [19]

Fromm et al.

[11] Patent Number: 5,210,463

[45] Date of Patent: May 11, 1993

[54] METAL HALIDE LOW-POWER HIGH-PRESSURE DISCHARGE LAMP

[75] Inventors: Dietrich Fromm, Warngau; Andreas Hohlfeld, Berlin, both of Fed. Rep. of Germany

[73] Assignee: Patent Treuhand Gesellschaft fur Elektrische Gluhlampen m.b.H., Munich, Fed. Rep. of Germany

[21] Appl. No.: 664,368

[22] Filed: Mar. 4, 1991

[30] Foreign Application Priority Data

Mar. 15, 1990 [DE] Fed. Rep. of Germany ..... 4008375

[51] Int. Cl.[5] ..... H01J 61/04

[52] U.S. Cl. ..... 313/631; 313/621

[58] Field of Search ..... 313/25, 631, 634, 623, 313/112, 621

[56] References Cited

U.S. PATENT DOCUMENTS

| | | | |
|---|---|---|---|
| 4,396,857 | 8/1983 | Danko | 313/634 |
| 4,633,136 | 12/1986 | Fromm et al. | 313/623 |
| 4,717,852 | 1/1988 | Dobrusskin et al. | 313/25 |
| 4,724,358 | 2/1988 | Inukai | 313/628 |
| 4,851,735 | 7/1989 | Gosslar et al. | 313/631 |
| 4,968,916 | 11/1990 | Davenport et al. | 313/571 |
| 5,001,397 | 3/1991 | der Kindreen | 313/631 |
| 5,004,951 | 4/1991 | Honda et al. | 313/631 |

FOREIGN PATENT DOCUMENTS

| | | |
|---|---|---|
| 491176 | 8/1938 | United Kingdom . |
| 2080018 | 1/1982 | United Kingdom . |

*Primary Examiner*—Donald J. Yusko
*Assistant Examiner*—Michael Horabik
*Attorney, Agent, or Firm*—Frishauf, Holtz, Goodman & Woodward

[57] ABSTRACT

Low-power, high-pressure discharge lamps, that is lamps having a power rating below and up to about 400 W, have a quartz discharge vessel retaining a metal halide fill which, to obtain a color temperature between 2700° to 3400° C. contains sodium and tin. To prevent deterioration of the electrode head (19; 39; 59), it is formed in essentially cylindrical or frusto-conical outer contour, which has a mass determined by the formula $M = i_L \times (23 \pm 8)$, and is retained on an electrode pin or shaft (17; 38; 58) having a diameter (d) in millimeters $$d = \sqrt{0.083 \times i_L \pm 0.02},$$

wherein $i_L$ is the effective value of the lamp current in amperes. Preferably, the electrode head (19) extends beyond the end portion of the electrode pin to define a small depression with respect thereto. The particular shape and dimension of the electrode head and the electrode shaft reduces flicker and electrode burning.

20 Claims, 4 Drawing Sheets

METAL HALIDE LOW-POWER HIGH-PRESSURE DISCHARGE LAMP

Reference to related patent, the disclosure of which is hereby incorporated by reference:

U.S. Pat. No. 4,396,857;
U.S. Pat. No. 4,851,735, Gosslar et al;
U.S. Pat. No. 4,717,852, Dobrusskin et al;
U.S. Pat. No. 4,633,136, Fromm et al.

FIELD OF THE INVENTION

The present invention relates to a high-pressure discharge lamp, and more particularly to a metal halide high-pressure discharge lamp of comparatively low power, especially for example to 150 W, or to about 400 W, and suitable for operation directly from a power network, for example of 50 or 60 Hz frequency.

BACKGROUND

It is known to make electrodes for discharge lamps which are formed by a core pin or the like and one or more wire windings or wraps about the core, in which the wire wraps or windings may have a single layer or a plurality of layers above each other. The tip of the core pin extends beyond this electrode head formed by the wrapped wire, in order to provide a discharge point for the discharge arc. U.S. Pat. No. 4,396,857, the disclosure of which is hereby incorporated by reference, has an electrode structure of this type.

It has been found that high-pressure discharge lamps with metal halides which contain specific fills, so that the color temperature will be between about 2700 to 3400K, cannot use such an electrode construction. The fill for such lamps contain sodium and/or tin, so that the desired color temperature can be obtained. In operation, the fill of this lamp will result in rapid burning-off of the electrode tips. As a consequence, the arc will extend and the operating voltage as well as the re-ignition peak will increase. The burning-off of the electrode thus limits the useful life of the lamp, which extinguishes or fails when the re-ignition peak exceeds the no-load voltage.

Burn-off of the electrode tips can be reduced by constructing the electrode shafts in sturdy massive construction within the region where the arc is struck. Unfortunately, however, this solution is not suitable in lamps intended for operation directly from a power network of, for example, 50 to 60 Hz frequency, since the flicker factor is substantially increased. Use of these lamps for interior or general service illumination, for which they are particularly suitable, is visually annoying.

THE INVENTION

It is an object to provide a metal halide high-pressure discharge lamp which has an electrode construction which permits the use of sodium and tin in the fill of the lamp while still having only low electrode burn-off and, further, a low flicker factor; further, the characteristics of the lamp should remain unchanged as the lamp is rotated about the axis of the arc. The electrodes should be simple, easy to manufacture, and axial symmetry maintained.

Briefly, each of the electrodes has an electrode head which has an outer shape which is essentially cylindrical or frusto-conical. The end or tip of each electrode shaft extends at most only up to the end of the electrode head which is exposed to the discharge arc and, preferably, just a little therebelow to form a shallow depression. The electrode shaft has a diameter d in millimeters defined by a specific relationship, namely $$d = \sqrt{0.083 \times i_L} \tag{1}$$

and, further, the electrode head together with the portion of the electrode shaft which is within the electrode head has a mass M, in milligrams, defined by the relationship $$M = i_L \times (23 \pm 8) \tag{2}$$

wherein $i_L$ is the effective value of the lamp current in amperes.

It has been found, by measurement with such electrodes, that both electrode burn-off and flicker factor have optimal characteristics when the diameter d of the electrode shaft is constructed in accordance with the above formula (1) and the mass of the electrode head, including the portion of the electrode pin or shaft therein likewise follow the above-given relationship (2).

In general, the pin diameter could be reduced beyond the relationship above given, and the flicker factor further improved, since the heat conduction away from the electrode head towards the seal, typically a pinch seal, and which is responsible for the flicker factor, is further reduced. In actual practice, however, it has been found that the advantages obtained are only marginal, and particularly so with respect to the overall lamp life, since, due to corrosion of the thin electrode pin at the transition to the pinch seal, a shaft for the electrode which is too thin leads to premature lamp failure. The average lifetime required for lamps of this type is in the order of about 6000 hours. For maintaining such rated life, the value under the root should not be reduced by more than about 0.02.

Upon increasing the value beneath the root, for example by a value of up to about 0.02, the flicker factor increases and may exceed the disturbance or annoyance threshold of 0.25% of average light. For most suitable use, thus, the formula for the thickness or diameter d of the electrode pin could be replaced by the formula $$d = \sqrt{0.083 \times i_L \pm 0.02} \tag{1a}$$

which determines the practical and suitable limits.

The shape of the electrode head preferably is cylindrical or frusto-conical. It is important that the tip of the electrode pin does not extend beyond the end of the electrode head facing the arc. With respect to the relationship for the mass M of the electrode head, in milligrams, inclusive of that portion of the electrode shaft or pin which extends therein, it has been found that increasing the variable factor upwardly causes an increase in the flicker factor; if the fixed value is decreased below that given by the formula, burn-off of the electrode head will cause failure of the lamp prior to the rated lifetime of 6000 hours.

In accordance with a feature of the invention, and to obtain a further improvement of the flicker factor, the tip of the electrode shaft or pin is set back from the end of the electrode head, by a distance of up to about two diameters of the electrode shaft or pin. A set-back of between one to two diameters is suitable. The result will be the formation of a shallow bowl-like depression at the head of the electrode in the center thereof.

The electrode can be made easily and inexpensively by forming the electrode head of one or more wraps or windings of a wire, wound next to and/or above each other. A suitable wire is a wire which is based on tungsten with the addition of a small quantity of potassium to increase workability thereof. Alternatively, the electrode head can be made in form of a tungsten sinter body.

DRAWINGS

DETAILED DESCRIPTION

Figure 1:
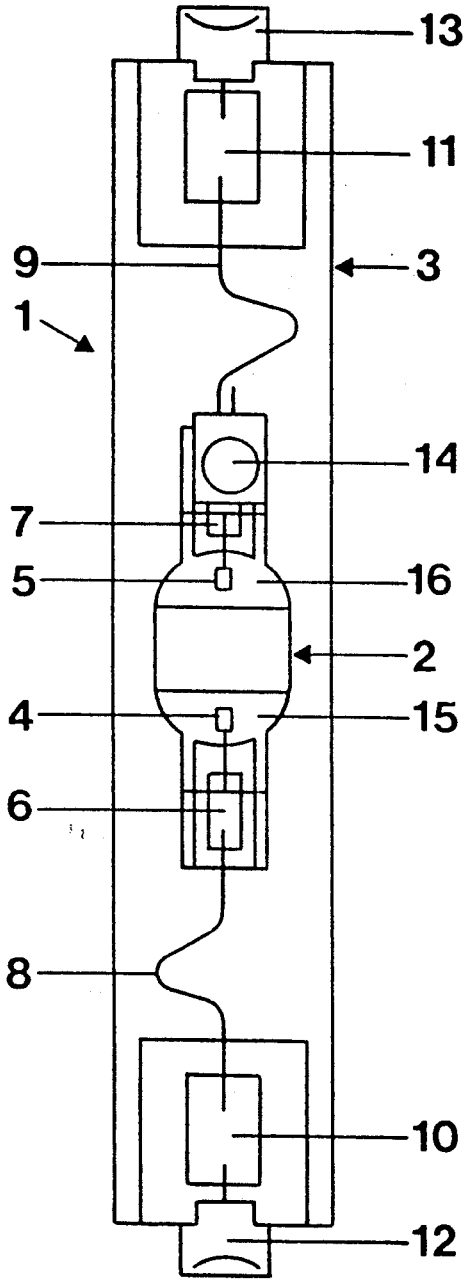
FIG. 1 is a side view of a double-ended discharge lamp using the electrodes of the present invention.
Figure 2:
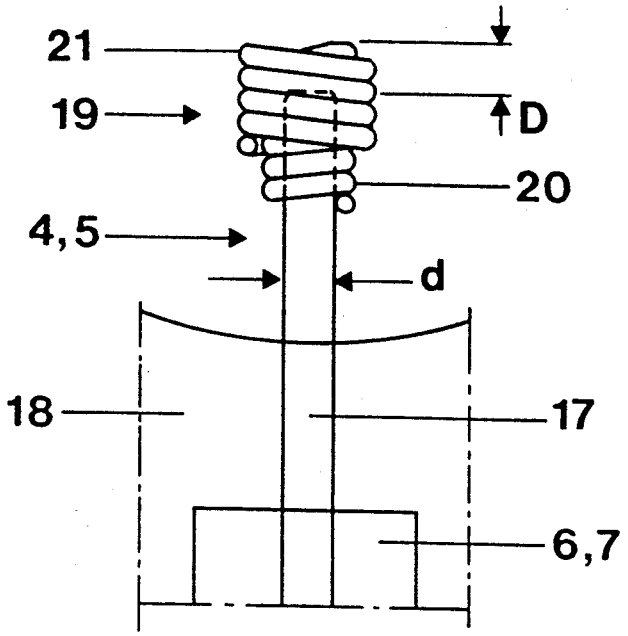
FIG. 2 is a greatly enlarged detail of one electrode of the lamp of FIG. 1.

Referring first to FIGS. 1 and 2:

A 70 W high-pressure discharge lamp 1 has a double-ended pinch-sealed discharge vessel 2 of quartz glass which is surrounded by an outer bulb or transparent housing 3. The electrodes 4, 5, shown only schematically in FIG. 1, are connected to foils 6, 7 which are pinch-sealed in the electrode discharge vessel 2, and connected to current supply leads 8 and 9 which are connected to sealing foils 10, 11 which, in turn, are pinch-sealed in the ends of the outer bulb 3, and then coupled to suitable end bases 12, 13, for example of ceramic, and which may be of the type R7s. Getter material 14, supported by a short wire element, is secured in one of the pinch seals of the discharge vessel 2, but not otherwise electrically connected to any terminal. The ends 15, 16 of the discharge vessel 2 are provided with a heat reflective coating thereon.

The fill for the discharge vessel 2 includes a noble gas, mercury, and metal iodide and bromide, in which the metals include sodium, tin, thallium, indium and lithium. The lamp 1 has a rated power of 70 W, a nominal effective current of 0.9 A and provides light output of 70 lm/W.

The electrode for the lamp 1 is seen to an enlarged scale in FIG. 2, and contains, basically, an electrode pin or shaft 17 which is 7.2 mm long and has a diameter of 0.25 mm. It is this shaft which is connected to the sealing foils 6 and 7, respectively, to be pinch-sealed gas-tightly in the pinch seal 18. The electrode head 19 is formed of a double-layer winding, in which the inner winding or coil 20 is formed of six tightly wound turns. The outer winding or coil 21 is formed of four tightly wound turns. The windings or coils 20, 21 are made of wire having a diameter of 0.2 mm.

In accordance with the present invention, and specifically in accordance with a preferred feature thereof, the double-layer winding of the electrode head 19 projects by 0.5 mm beyond the free end of the electrode pin 17. Both the electrode head 19 and the electrode shaft 17 are made of tungsten wire containing a small amount of potassium. No emitter material is contained in the electrode head.

The present invention is equally applicable to a single-ended high-pressure discharge lamp.

Figure 3:
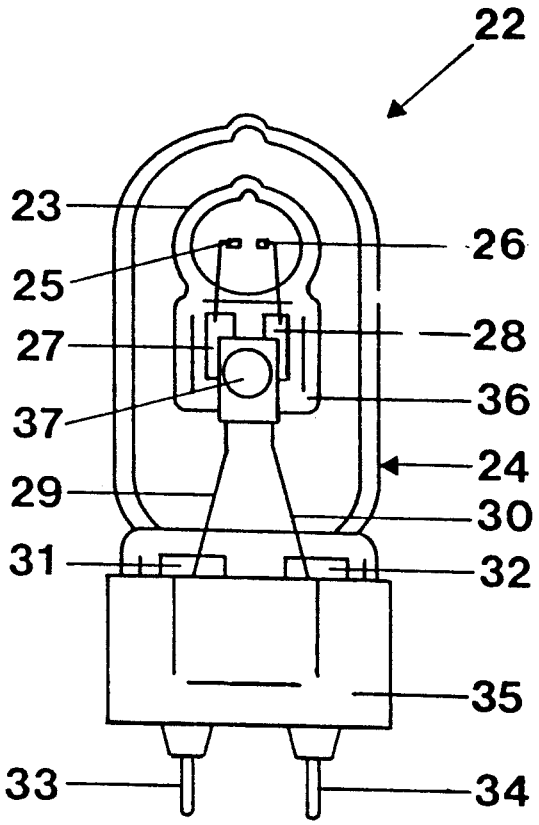
FIG. 3 is a front view of a single-ended discharge lamp using the electrode in accordance with the present invention.
Figure 4:
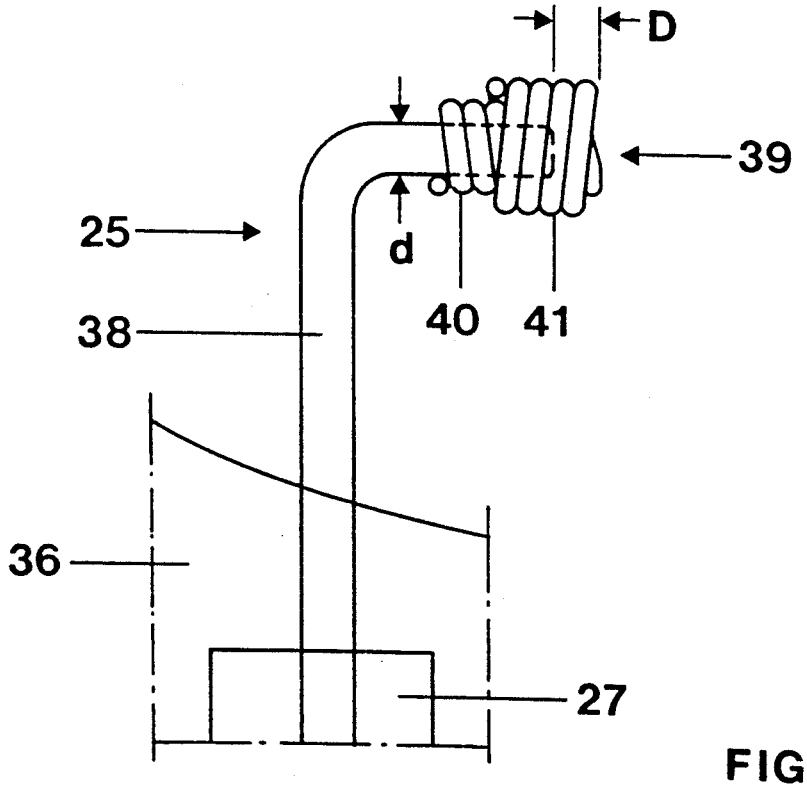
FIG. 4 is a greatly enlarged detail view of an electrode for the lamp of FIG. 3.

Referring now to FIGS. 3 and 4:

A single-ended 35 W high-pressure discharge lamp 22 has a quartz glass discharge vessel 23 with a single-ended pinch seal 36, surrounded by an outer bulb 24 in gas-tight manner. The electrodes 25, 26, shown only schematically in FIG. 3, are coupled via foils 27, 28 which are pinch-sealed in the discharge vessel 23 and connected to current supply leads 29, 30, further sealing foils 31, 32 in the outer bulb 24, and connected to electrical contact terminals 33, 34 of a ceramic base 35, for example of the type G 12. The pinch seal 36 of the discharge vessel 23 also secures a small metal plate of getter material 37, supported by a small wire element. The fill of the lamp 22 can be the same as that of the lamp 1, above described. The effective nominal current of the lamp 22 will be 0.5 A, resulting in a light output of 57 lm/W.

Electrode 25 of the discharge lamp 22 of FIG. 3 is best seen in FIG. 4. The electrode has an electrode pin or shaft 38 which is pinch-sealed gas-tight via the sealing foil 27 in the pinch seal 36. The other end of the pin 38 is bent over at a right angle with respect to the initial direction of the pin 38, and the bent-over end supports the electrode head 39, facing the discharge arc, that is, the other electrode. The electrode head 39 is formed of a double-layer wire coil, having an inner coil or wrap 40 formed of six tightly wound windings and an outer coil 41 formed of four tightly wound windings. The electrode head 39 slightly extends beyond the free end of the electrode pin 38. The wire wraps 40, 41 as well as the electrode pin or shaft 38 are formed of tungsten wire containing a small amount of potassium. The electrode does not contain emitter material.

Figure 5:
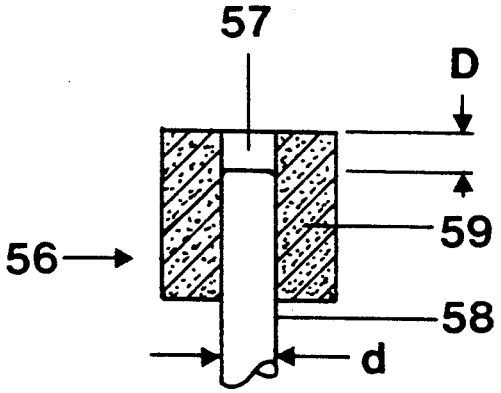
FIG. 5 is a fragmentary detail view of the sinter electrode suitable for use in either of the lamps of FIGS. 1 or 3.

Rather than forming the electrode heads of wrapped wire turns, they can be made of sintered tungsten. FIG. 5 shows an electrode 56 secured to an electrode shaft 58, which can be arranged in any of the lamps 1 or 3, facing a similar counter electrode. The shaft 58 is surrounded by a sintered tungsten body 59. The end portion of the essentially pure tungsten body 59 forms a slightly bowl-shaped depressed region 57, having a depression depth D which may vary from between one to two times the diameter d of the respective electrode shaft 58.

Figure 6:
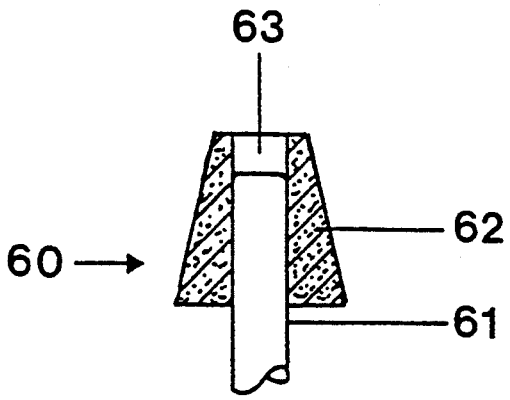
FIG. 6 illustrates another embodiment with a frusto-conical electrode.

FIG. 6 shows another embodiment, in which the electrode body is frusto-conical. An electrode 60 is secured to an electrode shaft 61, which can be arranged in any of the lamps of FIGS. 1 or 3 facing a similar counter electrode. The shaft 61 is surrounded by a sintered tungsten body 62 with a frusto-conical shape. The end portion of the essentially pure tungsten body 62 forms a slightly bowl-shaped depressed region 63.

Various changes and modifications may be made within the scope of the inventive concept.

We claim:

1. A low-power, high-pressure, essentially flicker-free discharge lamp suitable for operation at power network frequency, said lamp having a discharge vessel (2, 23);

a fill of mercury, a noble gas, and a metal halide;

two electrodes (4, 5; 25, 26; 56; 60) in said vessel, each electrode having an electrode shaft (17; 38; 58; 61)

and an electrode head (19; 39; 59; 62) at an end portion of the electrode shaft;

sealing foils (6, 7; 27, 28) connected to said electrodes and pressure-sealed into at least one end portion of said vessel, and comprising an arrangement of the electrodes for obtaining essentially flicker-free operation when operated at power network frequency and low electrode burn-off, wherein each electrode head (19; 39; 59; 62) has an outer shape which is essentially cylindrical or frusto-conical, the end or tip of each electrode shaft (17; 38; 58) extends at most only up to the end of the electrode head (19; 39; 59; 62) at the side which is exposed to the discharge arc;

the electrode shaft (17; 38; 58; 60) has a diameter d in millimeters defined by the relationship $$d = \sqrt{0.083 \times i_L} \quad (1)$$

and wherein the electrode head (19; 39; 59) and that portion of the electrode shaft (17; 38; 58) which is within the electrode head has a mass M in milligrams defined by the relationship $$M = i_L \times (23 \pm 8) \quad (2)$$

and wherein $i_L$ is the effective value of the lamp current in amperes.

2. The lamp of claim 1, wherein the end or tip of the electrode shaft (17; 38; 58; 61) is recessed with respect to the end or tip of the electrode head.

3. The lamp of claim 2, wherein the extent of recess (D) of the electrode shaft (17; 38; 58; 61) is in the range of between one or two diameters of said electrode shaft.

4. The lamp of claim 1, wherein the electrode head (19, 39) is formed of one or more coils of wire turns.

5. The lamp of claim 4, wherein at least two coils of wire turns are wound above each other.

6. The lamp of claim 4, wherein said coils are tungsten wire having a small additive of potassium.

7. The lamp of claim 1, wherein said electrode head (59; 62) comprises a tungsten sinter body.

8. The lamp of claim 7, wherein said electrode head (59; 62) comprises a sinter body of essentially pure tungsten.

9. The lamp of claim 1, wherein said fill includes sodium and tin.

10. The lamp of claim 1, wherein the lamp has a power rating of up to about 400 W only.

11. A low-power, high-pressure, essentially flicker-free discharge lamp suitable for operation at power network frequency, said lamp having a discharge vessel (2, 23);

a fill of mercury, a noble gas, and a metal halide;

two electrodes (4, 5; 25, 26; 56; 60) in said vessel, each electrode having an electrode shaft (17; 38; 58; 61) and an electrode head (19; 39; 59; 62) at an end portion of the electrode shaft;

sealing foils (6, 7; 27, 28) connected to said electrodes and pressure-sealed into at least one end portion of said vessel, and comprising an arrangement of the electrodes for obtaining essentially flicker-free operation when operated at power network frequency and low electrode burn-off, wherein each electrode head (19; 39; 59; 62) has an outer shape which is essentially cylindrical or frusto-conical, the end or tip of each electrode shaft (17; 38; 58) extends at most only up to the end of the electrode head (19; 39; 59; 62) at the side which is exposed to the discharge arc;

the electrode shaft (17; 38; 58; 60) has a diameter d in millimeters defined by the relationship $$d = \sqrt{0.083 \times i_L \pm 0.02} \quad (1a)$$

and wherein the electrode head (19; 39; 59) and that portion of the electrode shaft (17; 38; 58) which is within the electrode head has a mass M in milligrams defined by the relationship $$M = i_L \times (23 \pm 8) \quad (2)$$

and wherein $i_L$ is the effective value of the lamp current in amperes.

12. The lamp of claim 11, wherein the end or tip of the electrode shaft (17; 38; 58; 61) is recessed with respect to the end or tip of the electrode head.

13. The lamp of claim 12, wherein the extent of recess (D) of the electrode shaft (17; 38; 58; 61) is in the range of between one or two diameters of said electrode shaft.

14. The lamp of claim 11, wherein the electrode head (19, 39) is formed of one or more coils of wire turns.

15. The lamp of claim 14, wherein at least two coils of wire turns are wound above each other.

16. The lamp of claim 14, wherein said coils are tungsten wire having a small additive of potassium.

17. The lamp of claim 11, wherein said electrode head (59; 62) comprises a tungsten sinter body.

18. The lamp of claim 17, wherein said electrode head (59; 62) comprises a sinter body of essentially pure tungsten.

19. The lamp of claim 11, wherein said fill includes sodium and tin.

20. The lamp of claim 11, wherein the lamp has a power rating of up to about 400 W only.

* * * * *